US005801140A

United States Patent [19]

Langley et al.

[11] Patent Number: 5,801,140

[45] Date of Patent: Sep. 1, 1998

[54] ENZYME DISPERSIONS, THEIR PRODUCTION AND COMPOSITIONS CONTAINING THEM

[75] Inventors: John Graham Langley; Kenneth Charles Symes; Kishor Kumar Mistry, all of West Yorkshire, United Kingdom

[73] Assignee: Allied Colloids Limited, West Yorkshire, United Kingdom

[21] Appl. No.: 545,603

[22] PCT Filed: May 5, 1994

[86] PCT No.: PCT/GB94/00960

§ 371 Date: Feb. 7, 1996

§ 102(e) Date: Feb. 7, 1996

[87] PCT Pub. No.: WO94/25560

PCT Pub. Date: Nov. 10, 1994

[30] Foreign Application Priority Data

May 5, 1993 [GB] United Kingdom ..... 9309243

[51] Int. Cl.[6] ..... C11D 3/386

[52] U.S. Cl. ..... 510/530; 435/188

[58] Field of Search ..... 510/392, 393, 510/421, 434, 408, 409, 415, 417, 418, 530; 435/187, 188

[56] References Cited

U.S. PATENT DOCUMENTS 4,115,292 9/1978 Richardson et al. ..... 510/392

5,324,445 6/1994 Langley et al. ..... 510/321

5,460,817 10/1995 Langley et al. ..... 424/408

5,492,646 2/1996 Langley et al. ..... 510/530

5,589,370 12/1996 Ratuiste et al. ..... 264/4.3

*Primary Examiner*—Paul Lieberman

*Assistant Examiner*—John R. Hardee

*Attorney, Agent, or Firm*—Sughrue, Mion, Zinn, Macpeak & Seas, PLLC

[57] ABSTRACT

A process for the production of stable fluid enzyme dispersions having a content of at least 0.5% by weight enzyme, in which the enzyme is present in the form of anhydrous particles of a diameter less than 30 μm, comprising emulsifying an enzyme composition into a water immiscible liquid in the presence of a polymeric dispersion stabilizer to form a stable dispersion of aqueous enzyme particles having a dry size below 30 μm dispersed in the liquid, and dehydrating the dispersed particles by azeotropic distillation, wherein before, during or after dehydrating the particles the process comprises adding an organic liquid which is less volatile than the water immiscible liquid and which is selected from surfactants and water miscible liquids to the dispersion and distilling the water immiscible liquid from the dispersion until the amount of the initial water immiscible liquid remaining in the dispersion is below 20% by weight of the liquid phase in the dispersion.

22 Claims, No Drawings

ENZYME DISPERSIONS, THEIR PRODUCTION AND COMPOSITIONS CONTAINING THEM

This invention relates to anhydrous dispersions of enzymes, their production and their use, especially, in the manufacture of liquid detergents.

Enzymes are generally produced commercially as a liquid concentrate, frequently derived from a fermentation broth. The enzyme tends to be destabilised if it remains in an aqueous environment and so it is conventional practice to convert it to an anhydrous form. For instance the concentrate may be spray dried in the presence of a polymeric binder that binds the dried enzyme particles into aggregates. It is necessary to avoid the enzyme being in the form of very fine powder, for instance below 20 μm, because of environmental and handling difficulties associated with finely powdered enzyme.

It is frequently desired to use the enzyme in the form of a liquid composition, for instance a liquid detergent when the enzyme is of a type that is usefully incorporated in a detergent. One conventional way of incorporating the enzyme into the detergent is by forming a slurry of spray dried enzyme in a liquid surfactant and incorporating this slurry with the other components of the liquid detergent. It is inconvenient to have to spray dry the enzyme initially, and the formulation and use of the slurry is also inconvenient.

International Patent Publication WO92/01775 discloses a method of preparation of a liquid enzyme formulation. The formulation is prepared by means of a precipitation technique. Powdered enzyme is dissolved in an organic water miscible solvent and precipitated using a surfactant. This method however has the above-described disadvantages associated with handling powdered enzymes.

We described in EP-A-356,239 and 356,240 various processes for handling enzymes and formulating them for use in, for instance, liquid detergents. These processes include processes in which a fermentation broth concentrate that contains enzyme is emulsified into an aliphatic hydrocarbon liquid containing a polymeric stabiliser under conditions to give a particle size of, for instance, below 3 μm and the resultant dispersion of aqueous enzyme droplets in hydrocarbon is subjected to azeotroping to form a stable dispersion of substantially anhydrous particles in hydrocarbon liquid. It is stated in EP-A-356,239 that the liquid compositions described in that can be incorporated into liquid detergent concentrates. The enzyme concentration in the detergent will always be low.

This results in the hydrocarbon liquid being carried into the detergent concentrate and this is undesirable.

Other processes for providing a stable dispersion of substantially anhydrous biologically produced material in a non-aqueous liquid are described in EP-A-128,661 and 284,367.

All the described processes that involve emulsification of an aqueous phase into a non-aqueous liquid depend for their success on the formation of a stable dispersion of the aqueous particles and, subsequently, the dry particles. Stability is achieved in those processes at least in part by using a liquid phase which is wholly immiscible with the aqueous phase (since otherwise the aqueous phase will tend to dissolve into it and form a solution rather than a fine emulsion).

It would be desirable to be able to provide conveniently a stable dispersion concentrate of anhydrous enzyme that could easily be incorporated into, for instance, a liquid detergent without loading the detergent with unwanted hydrocarbon or other water immiscible liquid.

According to the invention a stable fluid enzyme dispersion or a composition meltable to form such a dispersion is made by a process comprising emulsifying an aqueous enzyme composition into water-immiscible liquid in the presence of a polymeric dispersion-stabiliser to form a stable dispersion of aqueous enzyme particles having a dry size below about 30 μm dispersed in the liquid, and dehydrating the dispersed particles by azeotropic distillation, wherein before, during or after dehydrating the particles by azeotropic distillation an organic liquid which is less volatile than the water immiscible liquid and which is selected from surfactants and water-miscible liquids is added to the dispersion and the water-immiscible liquid is distilled from the dispersion until the amount of the initial water immiscible liquid remaining in the dispersion is from 0 to 20% by weight of the liquid phase of the dispersion.

In this process, the initial dispersion of very small aqueous enzyme particles is formed in hydrocarbon or other water immiscible liquid in the same general manner as discussed in the patent applications listed above, and this liquid phase is then mainly or wholly exchanged for a less volatile liquid phase formed of surfactant and/or water miscible liquid.

The process of the invention may be used for the preparation of novel enzyme dispersions.

According to a second aspect of the invention, we provide a stable, anhydrous, fluid dispersion in a non-aqueous liquid phase of anhydrous particles of enzyme or a composition meltable to form such a dispersion wherein the particles are all below about 30 μm in size, the dispersion is stabilised by the inclusion in the dispersion of polymeric dispersion-stabiliser, the amount of enzyme (on an active weight basis) in the dispersion is at least about 0.5% by weight of the dispersion, the amount of liquid hydrocarbon in the dispersion is less than 20% by weight of the non-aqueous liquid phase, and more than 80% by weight of the non-aqueous liquid phase is selected from surfactants and water miscible liquids.

The dispersion is itself substantially anhydrous, and so the total amount of water in the dispersion should be as low as possible. It is generally well below 10% by weight of the dispersion and is preferably below 5% and most preferably below 2% by weight of the dispersion.

As a result of providing the enzyme particles in the specified very small size, combined with the other essential features defined above, it is possible to provide a dispersion which can easily be blended into a liquid detergent or other liquid composition without carrying into that composition unacceptable amounts of liquid hydrocarbon.

The invention is not limited to any particular manner of making the stable dispersion. For instance a stable dispersion can be formed by blending preformed enzyme particles, or disintegratable aggregates of them, into the required liquid phase in the presence of polymeric dispersion stabiliser, but this incurs the disadvantage of previously forming the dry enzyme particles and of handling them.

Since the product of the invention, and the product of the process of the invention, is a dispersion in surfactant and/or water miscible liquid, it can be blended easily with compositions with which this fluid phase is wholly compatible, for instance liquid detergent compositions.

Accordingly, by the invention, it is possible to convert an aqueous enzyme concentrate in a single process into a stable anhydrous dispersion which can then easily be blended into a liquid detergent without carrying unwanted hydrocarbon into the liquid detergent.

The enzyme dispersion of the invention and the product of the process of the invention may also be conveniently used in the preparation of other liquid enzyme-containing compositions. They may for instance be incorporated into enzyme breakers for fracturing fluids. They may also be used in the textile industry to produce a single dose desizing product. Most preferably the enzyme dispersions are used for the production of liquid detergent compositions, therefore they will be described in terms of such use in the following description. However, the disclosures relating to liquid detergents will also be applicable to other uses.

Although the aqueous enzyme composition can be obtained by distributing previously dried enzyme into water, preferably the composition is a concentrate obtained from the initial fermentation or other biological production of the enzyme. This concentrate may have been concentrated, filtered or otherwise processed using any of the conventional techniques that are used for, for instance, preparing an enzyme concentrate for spray drying.

The enzyme may be of any desired type. When, as is preferred, the ultimate use of the composition is as a component of a liquid detergent, the enzyme may be selected from any of the conventional detergent enzymes such as proteases, lipases, amylases, cellulases, oxidases and peroxidases. Examples of commercially available enzymes include Savinase, Durazyme (proteases), Lipolase (lipase), Celluzyme (cellulase), Termamyl (amylase); all available from Novo Nordisk A/S.

The water immiscible liquid into which the aqueous enzyme concentrate is dispersed can be, for instance, a vegetable oil but is generally a halogenated hydrocarbon or a hydrocarbon. Any of the hydrocarbons conventionally used in reverse phase polymerisation processes can be used. The water immiscible liquid may comprise a blend of a relatively low boiling liquid that can be distilled off with the water during the azeotropic distillation stage and a higher boiling liquid that may be distilled off subsequently. Preferably the water immiscible liquid is selected such that all of it can be distilled at a temperature of below 100° C., generally under reduced pressure. Thus preferably distillation is conducted at a temperature of not more than 80° C., often not more than 70° C. and preferably not more than 50° C. By choosing liquids that are sufficiently volatile and by conducting the distillation at a sufficiently low pressure it is possible to conduct the distillation at temperatures as low as 30° C. The use of relatively volatile liquids and pressures such that distillation is conducted at low temperatures is desirable since it minimises the risk of thermal deactivation of the enzyme.

The water immiscible liquid into which the aqueous concentrate is dispersed must contain polymeric dispersion-stabiliser. This is generally an amphipathic polymeric material including both hydrophilic and hydrophobic units in the polymer. It may be an amphipathic acrylic polymer, for instance formed from hydrophilic acrylic (including methacrylic) anionic or cationic units and hydrophobic acrylic ester units. Preferably the polymeric dispersion-stabiliser is a non-ionic stabiliser. It may be a block copolymer, for instance an ethyleneoxide propyleneoxide copolymer or it may be a condensation product of, for instance, hydroxystearic acid with a polyethylene glycol or polyethylene imine.

The dried enzyme particles must have a size sufficiently small that they provide a stable dispersion and so normally have a size below 30 μm, often below 10 μm, frequently below 3 μm and typically around 1 μm, by which we mean that at least 90% by weight preferably at least 98% by weight, of the particles have the specified size. The mean particle size is generally below 2 μm. The dry size of the enzyme particles will be smaller than the initial size of the aqueous particles, and so the aqueous particles may have a size larger than 10 μum, for instance up to 20 μm. Preferably, however, the aqueous size is also below 10 μm.

The desired aqueous particle size may be achievable merely by homogenising the aqueous concentrate into the non-aqueous liquid in the presence of the chosen dispersion-stabiliser, for instance using any conventional homogenising apparatus such as a Silverson mill through which the composition is passed a sufficient number of times to achieve the desired particle size. Attainment of the desired small particle size can, however, be promoted by including a water-in-oil emulsifier. Suitable emulsifiers generally have a relatively low HLB, examples being sorbitan mono-oleate and ethoxylated fatty alcohols having a relatively short ethoxy chain. The HLB is generally in the range 3 to 8. Naturally occurring materials, eg lecithin, may be suitable as emulsifiers in certain systems.

It is necessary to select the nature and the amount of dispersion-stabiliser, and the nature and amount of emulsifier if present, having regard to the water immiscible liquid, the concentrate that is being emulsified into it, and the surfactant and/or water miscible liquid that is subsequently to replace the water immiscible liquid. The amount of emulsifier is generally in the range 0 to 5%, frequently 0.5 to 3% by weight of the dispersion of aqueous enzyme particles in water immiscible liquid.

The amount of dispersion-stabiliser in the initial aqueous dispersion may typically be 2 to 20%, often 5 to 10%. The amount based on the final dispersion in surfactant or water miscible liquid is generally in the range 2 to 30%, frequently 4 to 10%, by weight of the final composition. The amount based on anhydrous enzyme is typically 15 to 70% by weight.

Often all the dispersion-stabiliser that is required in the final dispersion is included in the initial aqueous dispersion. However if desired some of the dispersion-stabiliser (typically 0 to 80% and generally 0 to 50% of the total amount of dispersion-stabiliser), can be post-added, i.e. added after the initial aqueous dispersion has been formed. This post addition may be effected when the surfactant and/or water miscible liquid is added or subsequently.

The amount of liquid hydrocarbon, or other residual water immiscible liquid from the original dispersion, that is in the final dispersion must be below about 20% because it is undesirable to carry significant amounts of this liquid with the dispersion into the liquid detergent or other final product that is being made. By saying that the amount is below 20% of the liquid phase, we mean that the amount is below 20% of the weight of the continuous phase of the dispersion excluding any dispersion-stabiliser or emulsifier in it. Since the final dispersion generally consists only of the continuous phase and the anhydrous particles, this means that the amount is below 20% of the weight of everything in the dispersion excluding the anhydrous particles, emulsifier and dispersion-stabiliser. Generally this amount is as low as possible and so it is normally below 10%, and preferably below 5% by weight of the liquid phase. Ideally it is below 2%, most preferably 0. The amount of polymeric dispersion-stabiliser is excluded when determining the weight of the liquid phase, since most of that is present as a film absorbed into each particle.

At least 80% by weight of the non-aqueous liquid phase, (i.e. excluding the particles and the dispersion-stabiliser) is selected from surfactants and/or water miscible liquids, and preferably at least 90%, most preferably at least 95%, is selected from surfactants and/or water miscible liquids. These materials are chosen in order that the final composition has an appropriate compatibility with liquid detergents or other liquid compositions into which it may be blended. For instance if the non-aqueous liquid is a substantially anhydrous water miscible liquid, the composition can be blended with an aqueous liquid or with a liquid that is compatible with an aqueous liquid. If the non-aqueous liquid is a surfactant then the composition is generally compatible with other appropriately formulated surfactant blends. Suitable surfactants are themselves usually water miscible liquids but it is also possible to use, in the invention, water miscible liquids that are not surfactants. For instance it is possible to use solvents, hydrotopes or other liquids that are conventionally present in liquid detergents and which are not themselves surfactants. Examples are glycols. In general, suitable non-surfactant water miscible liquids are generally mono-hydroxy, di-hydroxy or tri-hydroxy compounds. Low molecular weight polyethyleneglycols and materials such as butyl cellosolve may be used.

Although suitable surfactants for use as the non-aqueous liquid can be cationic or anionic, it is generally preferred that they should be non-ionic. Suitable surfactants are preferably liquids at room temperature that are ethoxylates of alkylphenyls or of fatty alcohols, wherein the fatty group may be saturated or unsaturated (e.g. oleyl alcohol), mono- and di-glycerides and their derivatives, alkyl glucosides, sorbitan esters and ethoxylated derivatives of any of these.

The non-aqueous liquid in the final composition is preferably at least 80%, and most preferably at least 90%, formed of a surfactant, preferably non-ionic surfactant more preferably an ethoxylate of a fatty alcohol. A blend of surfactants may be used. The liquid phase may, if desired, be a solution of a solid surfactant or other material in a solvent that may be, for instance, a polyethyleneglycol or may itself be a liquid surfactant. The final dispersion is a fluid and a combination of solid surfactant and liquid surfactant or other solvent must be chosen with this in mind. A liquid phase comprising large amounts of solid surfactant may result in a dispersion which solidifies at room temperature. This may be acceptable if the dispersion can be produced, transported and used above the solidification temperature of the dispersion. This may be done where the liquid phase is, as described above, a solution of a solid surfactant in a solvent or is a solid surfactant alone. Where a solid surfactant is used the process of the invention is carried out at a temperature above the melting point of the surfactant. Alternatively a dispersion of this type may be produced at a temperature above the melting temperature of the liquid phase and subsequently allowed to solidify for transport purposes, to give a composition meltable to form the dispersion of the invention. This may then be melted when required for use to give the fluid dispersion. This may be useful where the dispersion is of a type or is to be transported in such a geographical area that it will deteriorate whilst in the fluid form. The formulator of the dispersion will choose surfactants, solvents for surfactants if any and other components to achieve a melting point of the dispersion which is appropriate.

The amount of enzyme (measured as active weight) in the final composition must be sufficiently high that the composition is a useful concentrate that can be added to, for instance, a liquid detergent to give the enzyme concentration desired in that. The amount will therefore be above the amount conventionally present in a liquid detergent. The amount in the concentration is generally at least about 0.5%, usually at least about 1% by weight of the final composition. Often the amount is above 2% and preferably above 5% It is often in the range 10% to 30% although amounts up to 40 or even 50% may be appropriate in some instances. The amount of enzyme, on an active weight basis, in the starting aqueous composition is generally in the range 0.2 to 30%, often 1 to 30%. This is lower than in the final composition because the starting compositions contain water and because the amount of water-immiscible liquid in the starting composition is often greater than the amount of water-miscible liquid or surfactant in the final composition.

In a preferred process according to the invention, the starting aqueous composition is subjected to azeotropic distillation until substantially all the water has been distilled from it, the surfactant and/or other water miscible liquid is then added and distillation is continued until most or all of the initial water immiscible liquid has been evaporated.

When adding surfactant as some or all of the final liquid phase of the dispersion, it is preferred that at least 70% by weight of the water, and preferably 90 to 100% of the water, is removed by distillation before adding the surfactant. However it is also possible to add the surfactant and/or other water miscible liquid before any of the water has been distilled from the dispersion or after some but not all (e.g. 20 to 80% by weight of the water) has been distilled from the dispersion.

If surfactant is being added to the dispersion while it still contains significant amounts of water, it is generally necessary that the added material should have a relatively low HLB, typically below 12 and preferably below 10 but usually above 6. Having a low HLB minimises the risk of the added surfactant destabilising the dispersion. However if the surfactant is being added after substantially all the water has been evaporated, it is satisfactory for the added surfactant to have a higher HLB, for instance up to 14 or more. For example when the added material is a fatty alcohol ethoxylate, this ethoxylate preferably has a relatively short ethoxy chain (e.g. up to about 6 or 7) ethoxy groups and a relatively low HLB (for instance from 7 or 8 up to 10 or 11) when added while the dispersion still contains at least 30% by weight water, but can be a longer ethoxylate (e.g. at least 7 ethoxy groups and HLB at least 12) when added after substantial dehydration of the composition.

The volatility of the added surfactant and/or water miscible liquid should be such that continued distillation of the water immiscible liquid results in removal of that liquid with little or no removal of added surfactant or water miscible liquid.

If desired, additional surfactant or water miscible liquid may be added after the distillation has been completed.

Although we refer to the initial removal of water and water immiscible liquid as azeotropic distillation, it should be understood that this term is being used in the sense normally associated with distillation of reverse phase polymerisation systems in that it merely requires the distillation both of water and water immiscible liquid, irrespective of whether or not a true azeotrope is being formed.

The aqueous enzyme composition that is dispersed initially in the water immiscible liquid can, as indicated, be a material such as an aqueous broth concentrate. It can consist solely of enzyme, water and biological residues associated with the enzyme (for instance as a result of the fermentation process by which it was produced). However it can be desirable to include other materials in the anhydrous particles of enzyme of the final composition. This can be achieved by incorporating such other materials in the aqueous enzyme composition before it is dispersed into the water immiscible liquid, and it is possible to emulsify an aqueous solution of such other materials into the water immiscible liquid simultaneously or separately with the emulsification of the aqueous enzyme composition into the liquid, whereupon the aqueous phases will merge within the liquid to form aqueous dispersed particles containing both the enzyme and the other material.

Suitable other materials that may be included are polymeric materials (in addition to the polymeric dispersion-stabiliser) and enzyme stabilising materials. The polymeric materials generally consist only of hydrophilic units. Suitable materials include, for instance, polyacrylamide or polyvinyl pyrollidone and may be selected as an enzyme-stabiliser. Other enzyme-stabilisers include polyols such as propylene glycol, sugars and sugar alcohols, lactic acid, boric acid and boric acid derivatives such as aromatic borate esters.

When the added material is present as an enzyme-stabiliser, it should be incorporated in stabilising amounts. These are generally 10 to 200%, often 10 to 80%, by weight of the active weight of enzyme.

Polymer that is included may be of a type and an amount such as to form a matrix, and this matrix may be intended to provide some degree of impermeability to water or other liquids, with the result that the dispersed particles comprise polymeric matrix below 30 μm, generally below 10 μm, in size wherein the polymeric matrix contains enzyme particles. Generally this is achieved by including a solution or an emulsion of a polymer, optionally in the form of a volatile salt, in the aqueous phase, for instance as described in EP-A-356239 or 35624A. Reference should be made to those for full description of suitable amounts and materials. The matrix polymer is preferably a cationic polymer.

The substantially anhydrous, stable, fluid dispersion of anhydrous enzyme in surfactant and/or water miscible liquid must have a stability such that it does not significantly settle out on standing for a month in that there is either no settlement or any settled material can easily be redispersed by stirring or shaking. The stability of the dispersion of aqueous enzyme particles can be less, provided that dispersion remains stable during the azeotropic and other distillation processes.

The anhydrous stable dispersion preferably is a relatively free flowing fluid and preferably has a viscosity below 4,000 centipoise, preferably before 1,000 centipoise and most preferably before 500 centipoise, when measured by a Brookfield RVT viscometer at 20° C. The preferred anhydrous compositions have a viscosity of 50 to 300 centipoise. It is necessary to select the amount of enzyme (generally 15 to 30% on an active weight basis based on the total dispersion) and the particle size (generally at least 90% by weight below 3 μm and a mean particle size of around 1 μm) and the dispersion-stabiliser and the liquid phase in order to achieve these properties. The liquid phase preferably consists wholly or mainly of ethoxylated fatty alcohol in an amount of 3 to 20% by weight of the composition. The polymeric dispersion-stabiliser is preferably, like the liquid phase, of a non-ionic material.

The stable, anhydrous, fluid composition of the invention is, when the enzyme is suitable for use in a detergent composition, normally combined with the other components of a liquid detergent. The anhydrous composition may be blended with a preformed liquid detergent or may be blended with one or more of the components of the liquid detergent, which are then combined with other components to form the final detergent. This liquid detergent may contain water, for instance up to 50%, or even 90%, by weight water with the balance being organic solvent and detergent components, but preferably the detergent is a substantially non-aqueous detergent composition, e.g., as described in EP-A-120659. When the detergent is non-aqueous, the anhydrous enzyme particles can either be free of polymer or may merely include stabilising polymer matrix.

A detergent composition of the invention comprises a surfactant which may be anionic, non-ionic, cationic, amphoteric or a mixture of these types. The detergent will usually contain 0–50% anionic surfactant such as linear alkyl benzene sulphonate (LAS), alpha-olefin sulphonate (AOS), alkyl sulphate (AS), alcohol ethoxy sulphate (AES) or soap. It may also contain 0–40% non-ionic surfactant such as nonyl phenol ethoxylate or alcohol ethoxylate. Furthermore, it may contain a polyhydroxy fatty acid amide surfactant (e.g., as described in WO 92/06154).

The pH (measured in aqueous detergent solution) will usually be neutral or alkaline, e.g., 7–11.

The detergent composition may contain 1–40% of a detergent builder such as zeolite, phosphate, phosphonate, citrate, NTA, EDTA or DTPA, alkenyl succinic anhydride, or silicate, or it may be unbuilt (i.e., essentially free of a detergent builder).

The detergent composition of the invention may be stabilised using conventional stabilising agents for the enzyme (s), e.g., a polyol such as e.g., propylene glycol, a sugar or sugar alcohol, lactic acid, boric acid, or a boric acid derivative, e.g., an aromatic borate ester, and the composition may be formulated as described in e.g., International Patent Applications Nos. WO 92/19709 and WO 92/19708.

The detergent composition of the invention may contain bleaching agents, e.g., perborate, percarbonate, tetraacetyl ethylene diamine (TAED), or nonanoyloxybenzene sulfonate (NOBS), and may be formulated as described in, e.g., International Patent Application No. WO 92/07057.

The detergent composition of the invention may also contain other conventional detergent ingredients, e.g., deflocculating polymers, fabric conditioners, foam boosters, foam depressors, anti-corrosion agents, soil-suspending agents, sequestering agents, anti-soil redeposition agents, dyes, bactericides, optical brighteners or perfumes.

Particular forms of detergent compositions within the scope of the invention include:

(a) A detergent composition formulated as an aqueous detergent liquid comprising anionic surfactant, non-ionic surfactant, organic acid, alkali, with a pH in use adjusted to a value between 7 and 10.5.

(b) A detergent composition formulated as a non-aqueous detergent liquid comprising a liquid non-ionic surfactant consisting essentially of linear alkoxylated primary alcohol, phosphate builder, alkali, with a pH in use adjusted to a value between about 7 and 10.5.

(c) A liquid compact detergent comprising 5–65% by weight of surfactant, 0–50% by weight of builder and 0–30% by weight of electrolyte.

(d) A non-aqueous liquid detergent comprising 1–30% bleaching agent, 2–30% surfactant, 0.30% builder, 0–30% electrolyte, 0–50% organic solvent and/or 0–50% liquid non-ionic surfactant.

(e) An aqueous liquid detergent comprising 1–30% bleaching agent, 2–30% surfactant, 0–30% builder, 0–40% water soluble organic solvents, 0–30% electrolyte, 5–50% water.

In further preferred embodiments, a detergent composition may be formulated as described in Research Disclosure 337 May 1992, disclosure No.33,791 (Use of enzyme crystal slurries in liquid detergents).

The enzymes may be incorporated in concentrations conventionally employed in detergents. It is at present contemplated that, in a detergent composition of the invention, the enzyme may be added in an amount corresponding to 0.001–100 mg enzyme per liter of wash liquor.

The following are some examples of the invention. In these we refer to various materials by their trade names.

Savinase, Durazyme and Lipolase are enzymes available from Novo Nordisk A/S.

Softanol 50 and Softanol 90 are aliphatic ethoxylated alcohols supplied by BP Chemicals and having, respectively HLB of about 10.5 and about 13.3 and degrees of ethoxylation of, respectively, 5 and 9 mole. Other surfactants which could be used in place of softanols include the Dobanol range of surfactants, also aliphatic ethoxylated alcohols, available from Shell Chemicals. Additives A, H and I are emulsifiers as set out below and additives B to G are polymeric dispersion-stabilisers.

| Additive | Name | Type |
|---|---|---|
| A | Span 80 | Sorbitan mono-oleate |
| B | AC Stabiliser | Amphipathic anionic acrylic polymer |
| C | Atpol SCS 2747 | Non-ionic polymeric stabiliser mixture |
| D | Atlas 1599A | Non-ionic condensate of PEG and hydroxysteric acid |
| E | Hypermer 246 | Non-ionic block copolymer surfactant |
| F | Hypermer 261 | Non-ionic block copolymer surfactant |
| G | Hypermer 296 | Polymeric surfactant |
| H | Brij 92 | Polyethoxylate (2 ethoxy groups) of oleyl alcohol |
| I | Lecithin WSB | Soya bean phosphatide |

Atpol, Atlas, Hypermer, Span, Brij and Softanol are trademarks. Materials A and C to H are supplied by ICI Limited.

EXAMPLE 1

Savinase Dispersion in Softanol 50

1600 g of Savinase concentrate (protease preparation supplied at 14.1% total solids by Novo Nordisk A/S) is mixed with 413 g of 29.4% polyvinylpyrrolidone solution and the pH of the aqueous mixture adjusted to pH7.0.

An oil phase is prepared by mixing 37.6 g inverse emulsifier additive A, 32 g polymeric dispersion-stabiliser B and 792.8 g volatile hydrocarbon solvent.

The aqueous mixture of enzyme/polymer is added to the oil phase under agitation and then homogenised with a high shear mixer (Silverson) until a mean droplet size of 1 μm is reached. During this stage, the temperature of the emulsion is maintained below 40° C. After emulsification, extra 1598 g of the volatile solvent is added as a diluent.

The resulting emulsion is warmed to 30° C. and water/solvent mixture distilled under reduced pressure at a constant temperature about 30° C. After removal of all water, 741 g of Softanol 50 is added to the enzyme dispersion. Then the temperature is allowed to rise to 100° C. under vacuum to remove the remaining volatile solvent.

The resultant product is cooled to room temperature. The final dispersion is Savinase plus polymer particles in non-ionic surfactant at 30% solids having an average particle diameter of 1 μm and viscosity of 1250 cP.

This process could be repeated using Softanol 90.

The process of Example 1 was repeated, using Softanol 50, with various additive systems. The results are set out in Table 1 wherein the additive is identified as above (I being Softanol 50) and the proportions of the additive are quoted by weight. In this table, and in Table 2 and 3 below, the result is indicated on a scale of 1 to 6, where 1 indicates a viscosity of below 300 cP (the best result) 2 indicates a viscosity of 300 to 500 cP, 3 a viscosity of 500 to 1,000 cP, 4 a viscosity of 1,000 to 2,000 cP and 5 a viscosity of 2,000 to 4,000 cP. 6 indicates a viscosity above 4000 cP. Such a product would normally need to be diluted before it could be blended with a liquid detergent.

TABLE 1

| Additive | Weight Ratio Dry Solids/ Dispersion-Sabiliser | Result |
|---|---|---|
| 1A + 1B | 5.0 | 3 |
| 1A + 2I | 2.5 | 3 |
| F | 5.0 | 1 |
| C | 5.0 | 1 |
| E | 5.0 | 1 |
| 1A + 1D | 5.0 | 1 |
| 9C + 1B | 5.0 | 2 |
| 9D + 1B | 5.0 | 3 |
| 1A + 1F | 5.0 | 1 |

EXAMPLE 2

The procedure described in Example 1 was repeated except that the Softanol 50 was added to the emulsion after emulsification rather than after removal of water on distillation.

The dried dispersion obtained has the same characterisations as the product of Example 1.

EXAMPLE 3

Durazyme dispersion in Softanol 90

1400 g of Durazyme concentrate (protease preparation supplied at 17.7% total solids by Novo Nordisk A/S) is mixed with 433 g of 29.4% poly (acrylamide) solution and the pH of the aqueous mixture adjusted to 7.0.

An oil phase is prepared by mixing 40.6 g inverse emulsifier, 34.3 g polymeric dispersion-stabiliser and 681.8 g volatile hydrocarbon solvent. Extra 1455.3 g of the volatile solvent is added after emulsification as a diluent.

The procedure for emulsion formation and distillation of water/solvent mixture was similar to Example 1 but 800.8 g Softanol 90 was added.

The resulting dispersion is Durazyme plus polymer particles in Softanol 90 (30% solids) having an average particle diameter of 1 μm and viscosity of 240 cP.

The process was repeated with various additive systems, as shown in Table 2.

TABLE 2

| Additive | Weight Ratio Dry Solids/ Dispersion-Sabiliser | Result |
|---|---|---|
| 1A + 1B | 5.0 | 3 |
| C | 5.0 | 1 |
| 1H + 1C | 5.0 | 2 |
| 9D + 1B | 5.0 | 1 |

TABLE 2-continued

| Additive | Weight Ratio Dry Solids/ Dispersion-Sabiliser | Result |
|---|---|---|
| 9C + 1B | 5.0 | 4 |
| 1A + 1F | 5.0 | 2 |

EXAMPLE 4

The procedure described in Example 3 was repeated except that the Softanol 90 was added after emulsification rather than after removal of water on distillation. The emulsion immediately thickened up to a gel mass.

EXAMPLE 5

Lipolase dispersion in Softanol 90

1200 g of Lipolase concentrate (lipase preparation supplied at 31% total solids by Novo Nordisk A/S) is adjusted to pH7.0 with addition of 4% sodium hydroxide solution.

An oil phase is prepared by mixing 100.2 g inverse emulsifier, 85.8 g polymeric dispersion-stabiliser and 460.2 g volatile hydrocarbon solvent. Extra 744 g of the volatile solvent is added after emulsification as a diluent.

The procedure for emulsion formation and distillation of water/solvent mixture was similar to Example 1. Softanol 90 (553.8 g) was added instead of Softanol 50.

The resulting dispersion is Lipolase dried particles in Softanol 90 at 30% solids having an average particle diameter of 1 μm and viscosity of 360 cP.

The process of Example 5 was repeated using Softanol 90 and various additive systems. The results are shown in Table 3. This indicates that this particular enzyme system generally needs larger amounts of the additive system than were used in those experiments.

TABLE 3

| Additive | Weight Ratio Dry Solids/ Dispersion-Sabiliser | Result |
|---|---|---|
| 1A + 1B | 2.5 | 5 |
| C | 2.5 | 6 |
| C | 1.5 | 6 |
| 1A + 1C | 2.5 | 6 |
| 1C + 1H | 2.5 | 1 |
| 1C + 1G | 2.5 | 4 |
| 1A + 1D | 2.5 | 6 |
| 1D + 1H | 2.5 | 5 |
| 5H + 4D + 1B | 2.5 | 6 |
| 1F + 1H | 2.5 | 1 |
| 1E + 1H | 2.5 | 1 |
| 1C + 1H | 2.5 | 1 |

EXAMPLE 6

The procedure described in Example 5 was repeated except that the Softanol 90 was added to the emulsion after emulsification rather than after removal of water on distillation. The emulsion immediately thickened up to a gel mass.

All of the processed enzyme products displayed>90% of the anticipated enzyme activity when re-dispersed into water.

EXAMPLE 7

Celluzyme dispersion in Softanol 50 (all parts are by weight).

An oil phase was prepared by warming and mixing a volatile hydrocarbon solvent (400 parts) with emulsifier A (60 parts) and dispersion-stabiliser F (50 parts) at 50° C. This oil phase was cooled to 30° C. and an aqueous phase consisting of about 35% dry solids crude cellulase (Celluzyme, Novo Nordisk A/S; 1000 parts) was milled in via an in-line mixer. The resulting emulsion was distilled to remove nearly all the water (>90%) over a 5 hour period at 30°–40° C. and about 10 mmHg. The resulting dispersion of essentially dry enzyme particles in residual hydrocarbon solvent/emulsion/dispersion-stabiliser was mixed with the fatty acid ethoxylate (Softanol 50; 700 parts) and vacuum distillation continued up to 100° C. to remove nearly all the hydrocarbon solvent.

The final product on cooling was a fluid dispersion of cellulose enzyme (approx 30% w/w) in Softanol 50 plus the dispersion-stabiliser and emulsifier. On determination of cellulose activity by hydrolysis of a carboxymethyl cellulose substrate it was found that greater than 90% of the original activity had been recovered.

EXAMPLE 8

Savinase dispersion in Softanol 50.

A Savinase/polyvinylpyrrol done dispersion in Softanol 50 was prepared essentially as described in Example 7 but replacing the 32 parts polymeric dispersion-stabiliser B by an equal weight of dispersion-stabiliser I (White Sea and Baltic Co UK). On distillation a fluid product containing 30% dispersed phase results.

We claim:

1. A process for making a stable fluid dispersion of an enzyme or composition meltable to form such a dispersion comprising emulsifying an enzyme composition into water immiscible liquid in the presence of a polymeric dispersion stabiliser to form a stable dispersion of aqueous enzyme particles having a dry size below 30 μm dispersed in the liquid, and dehydrating the dispersed particles by azeotropic distillation, and in which before, during or after dehydrating the particles an organic liquid which is less volatile than the water immiscible liquid and which is selected from surfactants and water miscible liquids is then added to the dispersion and the water immiscible liquid is distilled from the dispersion until the amount of the initial water immiscible liquid remaining in the dispersion is below 20% by weight of the liquid phase in the dispersion.

2. A process according to claim 1 in which at least 70% by weight of the water is removed by distillation before adding surfactant or water miscible liquid.

3. A process according to claim 1 in which the aqueous enzyme particles include a material selected from enzyme stabilisers and polymers.

4. A process for making a substantially anhydrous stable fluid dispersion of an enzyme or composition meltable to form such a dispersion comprising emulsifying an enzyme composition into water immiscible liquid in the presence of a polymeric dispersion stabilizer to form a stable dispersion of aqueous enzyme particles having a dry size below 30 μm dispersed in the liquid, and dehydrating the dispersed particles by azeotropic distillation, and in which before, during or after dehydrating the particles an organic liquid which is less volatile than the water immiscible liquid and which is surfactant added to the dispersion and the water immiscible liquid is then distilled from the dispersion until the amount of the initial water immiscible liquid remaining in the dispersion is below 20% by weight of the liquid phase in the dispersion and at least 80% by weight of the liquid phase in the dispersion produced is surfactant.

5. A process according to claim 1 in which the liquid phase in the dispersion produced comprises ethoxylated fatty alcohol having HLB of at least 7.

6. A process according to claim 1 in which the polymeric dispersion-stabiliser comprises amphipathic polymeric material.

7. A process according to claim 1 in which the amount of polymeric dispersion-stabiliser is from 2 to 20% by weight of the dispersion produced and/or 15 to 70% by weight of anhydrous enzyme.

8. A process according to claim 1 in which the aqueous enzyme particles have a dry size below 3 μm.

9. A process according to claim 1 in which in the dispersion produced the amount of enzyme (on an active weight basis) is at least about 0.5% by weight of the dispersion, the amount of liquid hydrocarbon in the liquid phase is below 20% by weight of the liquid phase, and more than 80% by weight of the liquid phase is selected from surfactants and water miscible liquids.

10. A process according to claim 1 in which the dispersion produced is subsequently solidified by reducing its temperature to below the melting point of the dispersion.

11. A stable fluid dispersion in a non-aqueous liquid phase of anhydrous particles of enzyme or a composition meltable to form such a dispersion wherein the particles are below about 30 μm in size, the dispersion is stabilised by the inclusion of polymeric dispersion stabiliser, the amount of enzyme (on an active weight basis) is at least about 0.5% by weight of the dispersion, the amount of liquid hydrocarbon in the liquid phase is below 20% by weight of the liquid phase, and more than 80% by weight of the liquid phase is selected from surfactants and water miscible liquids.

12. A dispersion or composition according to claim 11 in which the particles are below 3 μm in size.

13. A dispersion or composition according to claim 11 in which the polymeric dispersion-stabiliser comprises amphipathic polymeric material.

14. A dispersion or composition according to claim 11 in which at least 80% by weight of the liquid phase (excluding dispersion-stabiliser) is surfactant.

15. A dispersion or composition according to claim 11 in which at least 80% by weight of the liquid phase (excluding dispersion-stabiliser) is non-ionic liquid surfactant.

16. A dispersion or composition according to claim 11 in which the liquid phase comprises ethoxylated fatty alcohol having HLB of at least 7.

17. A dispersion or composition according to claim 11 in which the amount of dispersion-stabiliser is from 2 to 20% by weight of the final composition and/or 15 to 70% by weight of anhydrous enzyme.

18. A dispersion or composition according to claim 11 in which the anhydrous particles of enzyme comprise particles of enzyme and a material selected from enzyme stabilisers and polymers.

19. A liquid detergent composition made by blending a dispersion according to claim 11 with other detergent components.

20. A dispersion or composition according to claim 11, in which the amount of enzyme on an active weight basis is at least 2% by weight of the dispersion or composition.

21. A process according to claim 1 in which the amount of the initial water immiscible liquid remaining in the dispersion is below 5% by weight of the liquid phase in the dispersion.

22. A dispersion or composition according to claim 11 in which the amount of liquid hydrocarbon in the liquid phase is below 5% by weight of the liquid phase in the dispersion.

* * * * *